United States Patent [19]

Katchka et al.

[11] Patent Number: 4,655,803

[45] Date of Patent: Apr. 7, 1987

[54] BURNER CONTROL DEVICE AND METHOD OF MAKING THE SAME

[75] Inventors: Jay R. Katchka, Cypress; Richard W. McKinney, Lakewood, both of Calif.

[73] Assignee: Robertshaw Controls Company, Richmond, Va.

[21] Appl. No.: 767,722

[22] Filed: Aug. 20, 1985

[51] Int. Cl.[4] ..... B01D 50/00

[52] U.S. Cl. ..... 55/322; 55/417; 137/544; 29/157.1 R

[58] Field of Search ..... 55/319, 217, 320, 321, 55/322, 417, 420, 461; 236/15 A; 137/544, 550; 29/157.1 R

[56] References Cited

U.S. PATENT DOCUMENTS

| | | | |
|---|---|---|---|
| 3,915,678 | 10/1975 | Felker | 55/319 |
| 4,087,263 | 5/1978 | Schonmann | 55/320 |
| 4,205,972 | 6/1980 | Visos et al. | 55/417 |
| 4,285,662 | 8/1981 | Katchka et al. | 431/53 |

FOREIGN PATENT DOCUMENTS

| | | | |
|---|---|---|---|
| 1090498 | 10/1960 | Fed. Rep. of Germany | 55/417 |

*Primary Examiner*—Bernard Nozick

*Attorney, Agent, or Firm*—Candor, Candor & Tassone

[57] ABSTRACT

A control device for supplying fuel to a burner and a method of making the same are provided, the device comprising a housing having an inlet for being interconnected to a source of fuel and having an outlet for being interconnected to the burner, a control valve unit carried by the housing for connecting the inlet to the outlet when the control valve unit is in an open condition thereof, and a passage arrangement carried by the housing and having the passage thereof leading from the inlet to the control valve unit, the passage arrangement having structure that is adapted to cause the fuel to flow through a substantially U-shaped path between the inlet and the control valve unit.

10 Claims, 4 Drawing Figures

BURNER CONTROL DEVICE AND METHOD OF MAKING THE SAME

BACKGROUND OF THE INVENTION

1. Field of the Invention

This invention relates to a new control device for supplying fuel to a burner means as well as to a new method of making such a control device.

2. Prior Art Statement

It is known to provide a control device for supplying fuel to a burner means wherein the device comprises a housing means having an inlet means for being interconnected to a source of fuel and having an outlet means for being interconnected to the burner means, control valve means carried by the housing means for connecting the inlet means to the outlet means when the control valve means is in an open condition thereof, and passage defining means carried by the housing means and leading from the inlet means to the control valve means, the passage defining means having means that is adapted to cause the fuel to flow through substantially right angle paths between the inlet means and the control valve means. For example, see FIG. 1 of this application.

SUMMARY OF THE INVENTION

It is one feature of this invention to provide a new control device for supplying fuel to a burner means wherein the fuel flow path between the inlet means of the control device and the control valve means thereof is so arranged that at least some of the sediment and the like that might be contained in the fuel is adapted to fall out of the same before reaching the control valve means.

In particular, it was found according to the teachings of this invention that the passage defining means of the fuel control device between the inlet means thereof and the control valve means thereof can be so constructed and arranged that the same can have at least one substantially U-shaped fuel flow path between the inlet means and the control valve means to cause at least some of the sediment and the like that might be contained in the fuel to fall out of the same before the fuel flows to the control valve means.

For example, one embodiment of this invention provides a control device for supplying fuel to a burner means, the device comprising a housing means having an inlet means for being interconnected to a source of fuel and having an outlet means for being interconnected to the burner means, control valve means carried by the housing means for connecting the inlet means to the outlet means when the control valve means is in an open condition thereof, and passage defining means carried by the housing means and leading from the inlet means to the control valve means, the passage defining means having means that is adapted to cause the fuel to serially flow through a first substantially U-shaped path and a second substantially U-shaped path and a third substantially U-shaped path between the inlet means and the control valve means the first and third U-shaped paths each normally facing substantially vertically upwardly and the second U-shaped path normally facing substantially vertically downwardly and being disposed between the first and second U-shaped paths, the means of the passage defining means causing the first U-shaped path to have a yoke portion and a pair of legs respectively connected to the ends of the yoke portion and respectively having free ends remote from the yoke portion, the yoke portion normally being below the legs with the legs extending substantially vertically upwardly from the yoke portion, the inlet means interconnecting with one of the legs at the free end thereof, and a screen means disposed across the other of the legs at the free end thereof.

Accordingly, it is an object of this invention to provide a new control device for supplying fuel to a burner means, the device of this invention having one or more of the novel features of this invention as set forth above or hereinafter shown or described.

Another object of this invention is to provide a new method for making such a control device, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 2:
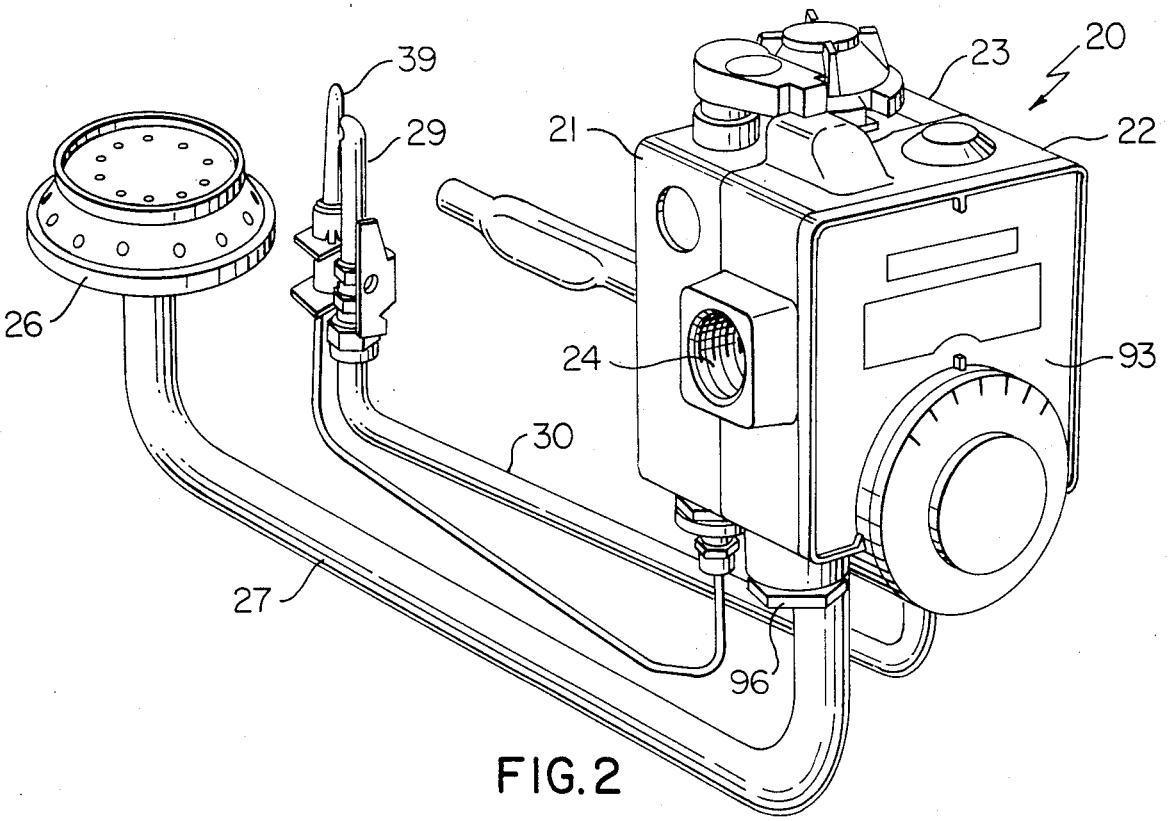
FIG. 2 is a perspective view of the new control device of this invention, the control device being interconnected to a main burner means and to a pilot burner means for the main burner means.

While the various features of this invention are hereinafter illustrated and described as being particularly adapted to provide a control device for supplying gaseous fuel to a burner means, such as from a source of liquid petroleum (L.P.) gas, it is to be understood that the various features of this invention can be utilized singly or in various combinations thereof to provide a control device for supplying other types of fuel as desired.

Therefore, this invention is not to be limited to only the embodiment illustrated in the drawings, because the drawings are merely utilized to illustrate one of the wide variety of uses of this invention.

Figure 3:
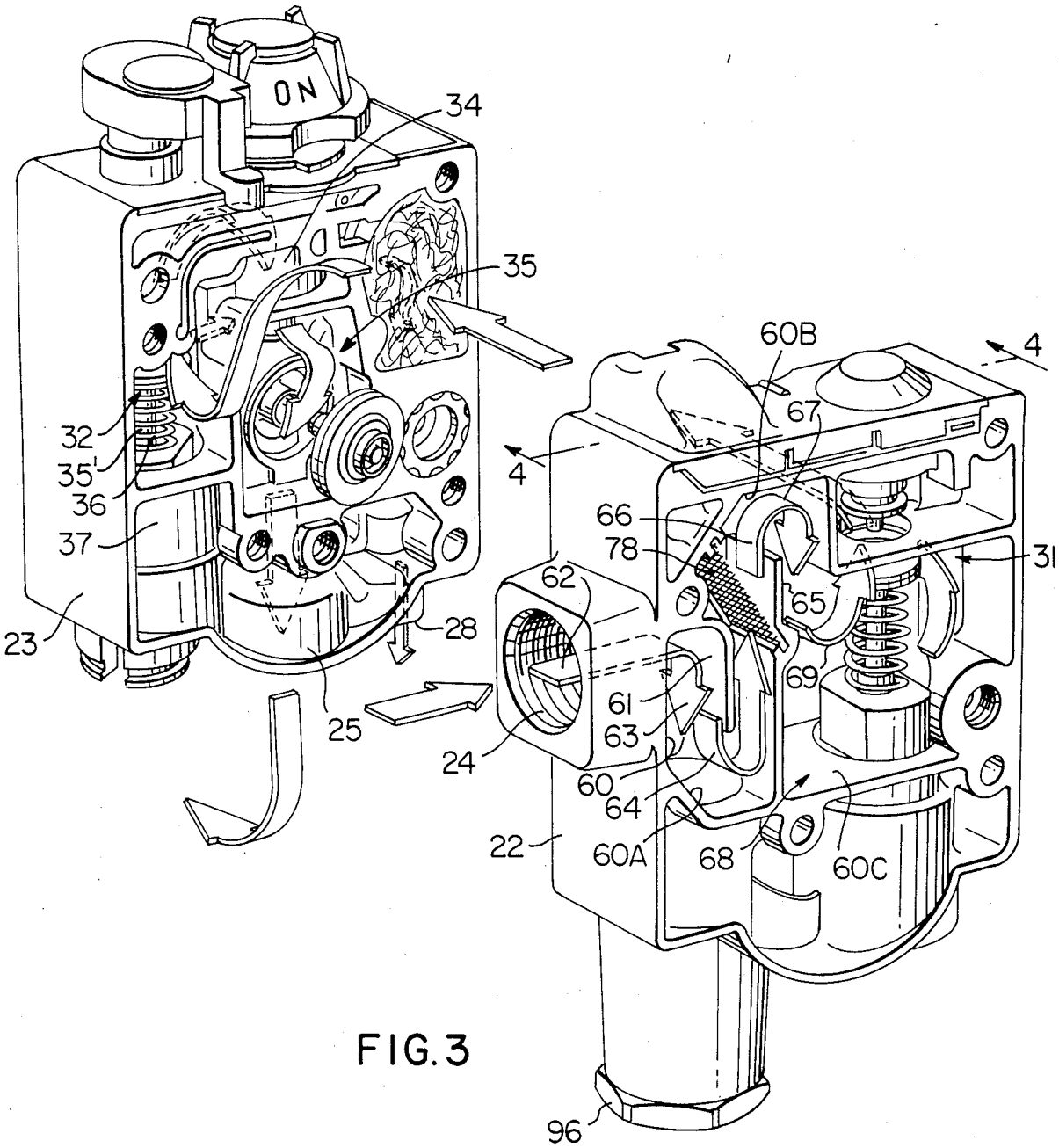
FIG. 3 is an exploded perspective view of the control device of FIG. 1 and schematically illustrates the flow of fuel through the control device when the control device is set in its "ON" position.
Figure 4:
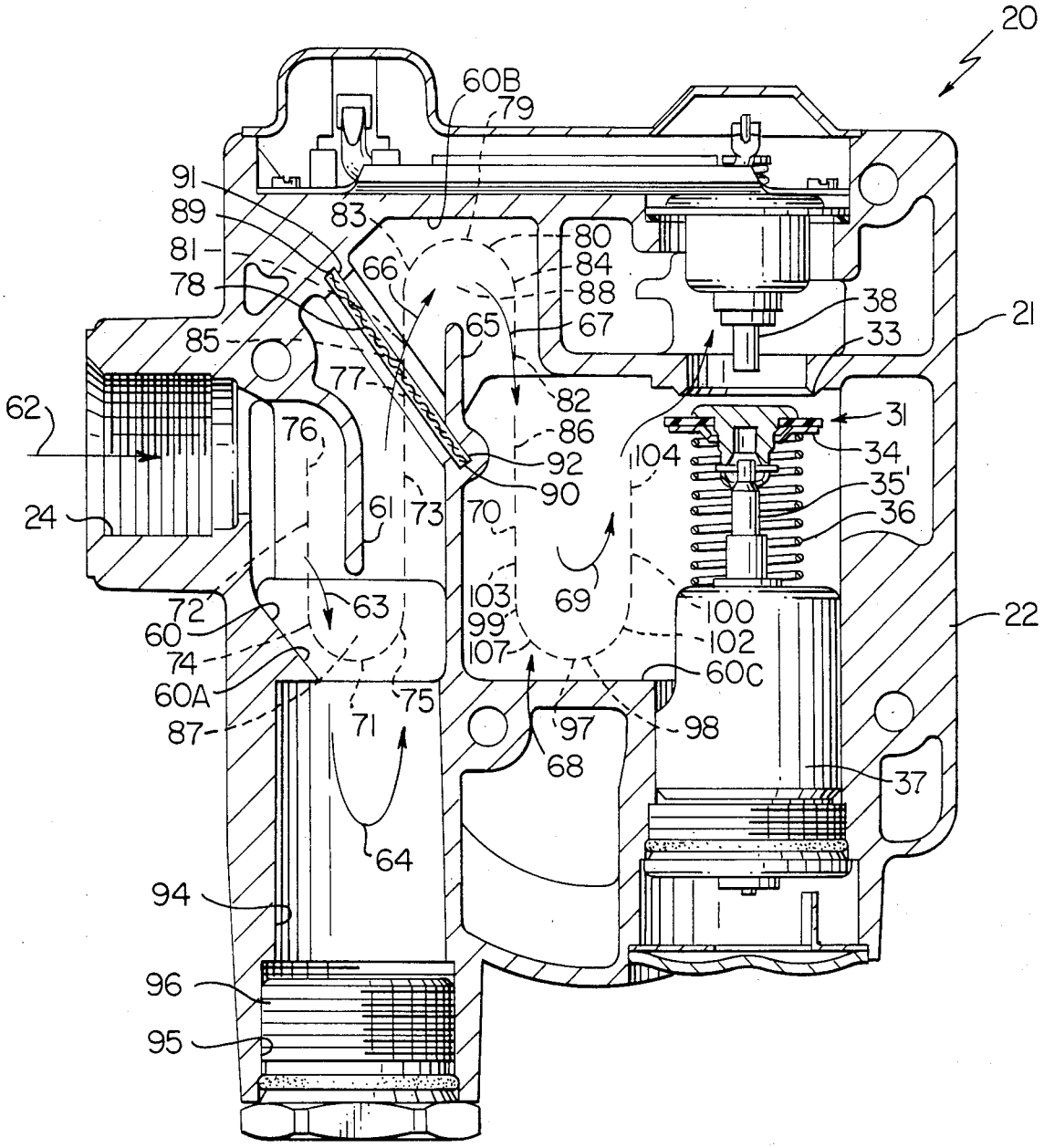
FIG. 4 is an enlarged cross-sectional view taken on line 4—4 of FIG. 3.

Referring now to FIGS. 2, 3 and 4, the new control device of this invention is generally indicated by the reference numeral 20 and comprises a housing means 21 formed of two housing parts of sections 22 and 23 suitably secured together and having an inlet means 24 for being interconnected to a fuel source (not shown but represented by the arrow 62 in FIG. 4) and a main outlet means 25 for being interconnected to a main burner means 26 by a conduit means 27 in a conventional manner. The housing means 21 also has a pilot burner outlet means 28, FIG. 3, for being interconnected to a pilot burner means 29 by a conduit means 30 in a conventional manner.

Fuel is adapted to flow from the inlet 24 of the control device 20 through a first control valve means 31, FIG. 4, in a manner hereinafter described and through a second control valve means 32, FIG. 3, and a plug valve means 34 to the pilot outlet 28 and to the main outlet 25 after passing through a thermostatically operated valve means 35 in a manner conventional in the art.

The control device 20 is fully disclosed and claimed in the copending patent application Ser. No. 767,721, filed Aug. 20, 1985, of Jay R. Katchka et al and therefore this copending patent application is being incorporated into this disclosure by this reference thereto. Therefore, only the details of the control device 20 necessary to understand the features of this invention will be hereinafter set forth.

In particular, the control valve means 31 and 32 each comprises a valve seat 33 adapted to be opened and closed by a valve member 34 carried on a valve stem 35' and normally being urged toward a closed position by a compression spring 36 disposed between the valve member 34 and a cylinder member 37 that has electromagnetic coil means (not shown) therein for holding an armature (not shown) of the stem 35' in a latched open position thereof when the valve member 34 has been moved to the open and latching position thereof by a movable plunger means 38 under the actuation of a reset actuator button and a thermocouple means 39, FIG. 2, is sensing the existence of a flame means at the pilot burner means 29 so that fuel can flow to the main burner means 26 as long as the control valve means 31 and 32 are disposed in an open condition thereof, the flow of fuel to the main burner means 26 downstream of the opened control valve means 31 and 32 being under the control of the thermostatically operated valve means 35 in a manner well known in the art.

For example, the operation of the control valve means 31 and 32 and the control device 20 is generally set forth in U.S. Pat. No. 4,285,662 to Katchka et al, and therefore this patent is being incorporated into this disclosure by this reference thereto so that a further description of the structure and operation of the valve means 31, 32, 34 and 35 need not be set forth.

The control device of the aforementioned to Katchka et al, U.S. Pat. No. 4,285,662 is illustrated in FIG. 1 and is generally indicated by the reference numeral 40, the control device 40 having an inlet 41 in the housing means 42 thereof leading directly to a control valve means 43 that comprises a movable valve member 44 and its cooperating valve seat 45 with the control valve means 43 being substantially the same as one of the control valve means 31 or 32 as previously set forth.

Figure 1:
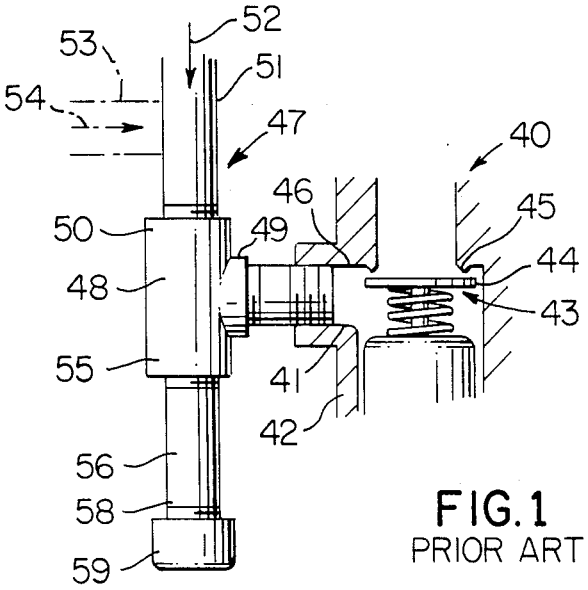
FIG. 1 PRIOR ART
FIG. 1 is a fragmentary view of a prior known control device with part of the control device being shown in cross section.

It can be seen in FIG. 1 that the inlet 41 defines a substantially straight line cylindrical passage means 46 that leads directly to the control valve means 43 in substantially a straight line manner.

In order to tend to remove sediment and the like from the gaseous fuel being fed into the inlet means 41 of the prior known control device 40, a prior known structure that is generally indicated by the reference numeral 47 has been utilized, the structure 47 comprising a T-member 48 having one leg 49 thereof coupled into the inlet 41 whereby the housing means 42 carries the structure 47 so that the structure, in effect, comprises part of the housing means 42 of the control device 40. Another leg 50 of the T-member 48 has an inlet pipe or conduit 51 threaded therein whereby fuel is adapted to flow from a source (not shown) into the T-member 48 in substantially a straight line manner as represented by the arrow 52. However, sometimes, the conduit 51 is provided with a right angled elbow that is indicated by the dash-dotted line 53 in FIG. 1 so that the fuel flow through the elbow 53 as represented by the arrow 54 makes a 90° turn before the same enters the T-member 48. In any event, the inlet conduit 51 now becomes the inlet means for the housing means 42 of the control device 40.

The remaining leg 55 of the T-member 48 has a short conduit 56 threaded therein at one end 57 of the conduit 56 while the other end 58 of the conduit 56 is closed off by a removable threaded end cap 59 which can be removed from time to time to empty any sediment that has become trapped in the lower end 58 of the conduit 56 during the operation of the control device 40.

In particular, as the fuel flows into the T-member 48 either from the direction 52 or the direction 54, the fuel must make approximately a 90° turn in order to pass out of the leg 50 and into the leg 49 that leads to the inlet 41 of the control device 40 and it has been found that such 90° turning of the flow of fuel causes at least some of the sediment or the like that might be contained in such gas or fuel to tend to fall by gravity to the end 58 of the conduit 56 which can be periodically removed by opening the end cap 59.

However, as previously set forth, it is one feature of this invention to provide the control device 20 of this invention with a unique passage means for sediment removing means and it was found according to the teachings of this invention that such unique passage means can be formed in the housing means 21 of the control device 20.

In particular, reference is now made to FIGS. 3 and 4 wherein it can be seen that the housing section 22 of the housing means 21 of the control device 20 has a passage defining means 60 formed therein intermediate the inlet means 24 and the first control valve means 31, the passage defining means 60 having a first baffle means 61 that causes the fuel that is flowing in its normal straight line horizontal flow path from the inlet 24, as represented by the arrow 62, to turn approximately 90° and flow in a downward direction that is approximately 90° from the inlet flow 62 as represented by the arrow 63 in FIG. 4 and then because of the part 60A of the passage means 60 turn approximately 180° as represented by the arrow 64 in FIG. 4 and flow upwardly until another baffle means 65 and the part 60B of the passage defining means 60 causes the upward flow of fuel as represented by the arrow 66 to turn approximately 180° as represented by the arrow 67 and flow downwardly into a chamber 68 of the housing means 21 that because of the part 60C of the passage defining means 60 causes the fuel flow to turn approximately 180° as represented by the arrow 69 in order to reach the valve seat 33 of the control valve means 31.

Thus, it can be seen that the means 60A and 61 of the passage defining means 60 causes the fuel to flow through a first substantially U-shaped path as represented by the dotted path 70 in FIG. 4 with the path 70 comprising a yoke portion 71 and a pair of legs 72 and 73 respectively connected to the opposed ends 74 and 75 of the yoke portion 71 and respectively having free ends 76 and 77 remote from the yoke portion 71. The inlet 24 therefore interconnects with the leg 71 of the path 70 at the free end 76 thereof. A filter screen 78, formed of metal or other suitable material, is carried by the housing means 21 and is disposed substantially completely across the flow path 70 at the free end 77 of the leg 73 thereof so as to screen the flow of fuel passing upwardly along the flow path leg 73 before the fuel follows the second U-shaped flow path of the passage defining means 60 which is illustrated by the dotted flow path 79 in FIG. 4 and created by the means 60B and 65 of the passage defining means 60. The flow path 79 also comprises a yoke portion 80 and a pair of legs 81 and 82 respectively connected to the opposed ends 83 and 84 of the yoke portion 80 and respectively having free ends 85 and 86. The free end 85 of the leg 81 of the U-shaped path 79 is interconnected in substantially a straight line manner to the free end 77 of the leg 73 of the U-shaped path 70 while the free end 86 of the leg 82 of the U-shaped flow path 79 is interconnected to the chamber 68 of the housing means 21.

In this manner, the resulting bight 87 of the first U-shaped path 70 faces substantially vertically upwardly in FIG. 4 while the bight 88 of the second U-shaped path 79 faces substantially vertically downwardly in a direction substantially opposite to facing direction of the bight 87 of the first U-shaped path 70.

The screen 78 is disposed at an angle across the leg 73 of the first flow path 70 and is held in such position by having its outer edges 89 and 90 received in suitable slots 91 and 92 formed in the housing means 21 as illustrated so that when a cover plate 93 (FIG. 2) of the control device 20 is removed as illustrated in FIG. 3, the screen 78 is adapted to be readily removed for any desired purpose, such as for being replaced with a new screen 78 as desired.

The passage defining means 60 of the housing means 21 defines a tubular portion 94 below the yoke portion 71 of the first U-shaped flow path 70 and has its lower end 95 closed by a removable plug means 96 so that any sediment or the like that has become trapped in the tubular portion 94 and has settled by gravity to the lower end 95 thereof, can be readily removed by removing the plug 96 in the same manner as the end cap 59 as previously described for structure 47 of FIG. 1.

The chamber 68 of the control device 20 has an end wall means 60C of the passage defining means 60 that cooperates with the passage defining means 60 to cause the fuel flowing out of the free end 86 of the leg 82 of the second U-shaped fuel flow path 79 to form a third substantially U-shaped flow path that is indicated by dotted lines in FIG. 4 and is designated by the reference numeral 97, the flow path 97 also having a yoke portion 98 and a pair of legs 99 and 100 respectively interconnected to the opposed ends 101 and 102 of the U-shaped portion 98 and respectively having free ends 103 and 104. The free end 103 of the leg 99 is interconnected to the free end 88 of the leg 82 of the second U-shaped flow path 79 in substantially a straight line manner while the free end 104 of the leg 100 of the third flow path 97 is directed in the direction toward the valve seat 33 of the control valve means 31. In this manner, the bight 105 of the third U-shaped flow path 97 faces substantially in the same direction as the bight 87 of the first U-shaped flow path 70 and thereby is facing in a direction opposite to the bight 88 of the second U-shaped flow path 79.

Therefore, it can be seen that the control device 20 of this invention can be formed with the unique passage defining means 60 of this invention by the method of this invention as previously set forth to provide a plurality of U-shaped flow paths 70, 79 and 97 between the inlet means 24 and the control valve means 31 so as to operate in a manner now to be described.

With the control device 20 of this invention having its inlet 24 interconnected to the source of fuel as represented by the arrow 62 in FIG. 4, and with the control valve means 31 and 32 thereof being disposed in the closed position thereof, it can be seen from FIG. 4 that fuel cannot flow through the valve seat 33 of the control valve means 31 so that there is no flow of fuel through the passage defining means 60.

However, once the control valve means 31 and 32 are disposed in the open condition thereof as illustrated in FIGS. 3 and 4, the fuel flowing in a substantially horizontal direction in FIGS. 3 and 4 through the inlet 24 is turned by the baffle means 61 so as to cause the same to flow in the substantially U-shaped path 70 whereby not only does the impingement of the fuel against the baffle means 61 tend to cause at least some of the sediment and the like that might be contained in the fuel to fall out of the same into the tubular portion 94 of the passage defining means 60, but also the reversing in the direction of flow thereof down the leg 76 across the yoke portion 71 and up along the leg 73 in a U-shaped manner tends to cause sediment and the like that might be contained in the gaseous fuel to fall by gravity into the tubular portion 94 of the passage defining means 60. In addition, the flow of fuel now upwardly along the leg 73 of the flow path 70 into the leg 81 of the second U-shaped flow path 79 passes through the screen 78 that tends to filter out at least some of the other particles of sediment or the like that might be contained in the gaseous fuel and fall by gravity from the screen 78 down the leg 73 into the tubular portion 95 to be collected at the end 95 thereof in the manner previously set forth.

In addition, the flow of fuel out of the screen 78 into the second U-shaped flow path 79 will also tend to cause at least some of the sediment or the like that might be contained in the fuel to fall out of the same by gravity because of the turning of the fuel through the U-shaped flow path 79. In addition, the flow of fuel through the third U-shaped flow path 97 will also tend to cause at least some of the sediment or the like that might be contained in the fuel to fall out of the same by gravity before the fuel flows upwardly along the leg 100 to pass through the valve seat 33 of the control valve means 31 and subsequently to the pilot burner means 29 and main burner means 26.

Subsequently, when the thermostatically controlled valve means 35 closes and thereby provides a reduced flow of fuel flow through the control device or when the control valve means 31 and 32 closes for any reason to completely terminate fuel flow through the control device 20, any particles of sediment or the like that might have been held against the screen 78 by the full flow of fuel passing therethrough can now fall by gravity into the portion 94 of the passage defining means 60 so as to be removed from the screen 78.

Therefore, it can be seen that this invention not only provides a new control device for supplying fuel to a burner means, but also this invention provides a new method of making such a control device.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a control device for supplying fuel to a burner means, said device comprising a housing means having an inlet means for being interconnected to a source of fuel and having an outlet means for being interconnected to said burner means, control valve means carried by said housing means for connecting said inlet means to said outlet means when said control valve means is in an open condition thereof, and passage defining means carried by said housing means and leading from said inlet means to said control valve means, the improvement wherein said passage defining means has means that is adapted to cause said fuel to serially flow through a first substantially U-shaped path and a second substantially U-shaped path and a third substantially U-shaped path between said inlet means and said control valve means, said first and third U-shaped paths each normally facing substantially vertically upwardly and said second U-shaped path normally facing substantially vertically downwardly and being disposed between said first and second U-shaped paths, said means of said passage defining means causing said first U-shaped path to have a yoke portion and a pair of legs respectively connected to the ends of said yoke portion and respectively having free ends remote from said yoke portion, said yoke portion normally being below said legs with said legs extending substantially vertically upwardly from said yoke portion, said inlet means interconnecting with one of said legs at said free end thereof, and a screen means disposed across the other of said legs at said free end thereof.

2. A control device as set forth in claim 1 wherein said inlet means interconnects with said one leg so that the flow of fuel from said inlet means into said one leg is adapted to be substantially transverse to the flow of fuel in that one leg to said yoke portion.

3. A control device as set forth in claim 1 wherein said passage defining means has a removable plug means at the bottom of said yoke portion.

4. A control device as set forth in claim 1 wherein said U-shaped flow paths are in aligned relation with said second U-shaped flow path being directly interconnected to said first and third U-shaped flow paths.

5. A control device as set forth in claim 4 wherein said first and third U-shaped flow paths are generally in side-by-side relation.

6. In a method of making a control device for supplying fuel to a burner means, said method comprising the steps of providing a housing means with an inlet means for being interconnected to a source of fuel and with an outlet means for being interconnected to said burner means, disposing control valve means so as to be carried by said housing means for connecting said inlet means to said outlet means when said control valve means is in an open condition thereof, and forming passage defining means so as to be carried by said housing means and lead from said inlet means to said control valve means, the improvement comprising the steps of forming said passage defining means to have means that is adapted to cause said fuel to serially flow through a first substantially U-shaped path and a second substantially U-shaped path and a third substantially U-shaped path between said inlet means and said control valve means, forming said first and third U-shaped paths to each normally face substantially vertically upwardly and said second U-shaped path to normally face substantially vertically downwardly and be disposed between said first and second U-shaped paths, said step of forming said means of said pasasge defining means causing said first U-shaped path to have a yoke portion and a pair of legs respectively connected to the ends of said yoke portion and respectively having free ends remote from said yoke portion and causing said yoke portion to normally be below said legs with said legs extending substantially vertically upwardly from said yoke portion, interconnecting said inlet means with one of said legs at said free end thereof, and disposing a screen means across the other of said legs at said free end thereof.

7. A method as set forth in claim 6 and including the step of interconnecting said inlet means with said one leg so that the flow of fuel from said inlet means into said one leg is adapted to be substantially transverse to the flow of fuel in that one leg to said yoke portion.

8. A method as set forth in claim 6 and including the step of forming said passage defining means to have a removable plug means at the bottom of said yoke portion.

9. A method as set forth in claim 6 and including the step of forming said U-shaped flow paths to be in aligned relation with said second U-shaped flow path to be directly interconnected to said first and third U-shaped flow paths.

10. A method as set forth in claim 9 and including the step of forming said first and third U-shaped flow paths to be generally in side-by-side relation.

* * * * *